United States Patent [19]

Masuda et al.

[11] 4,254,486

[45] Mar. 3, 1981

[54] DISPLAY PANEL FOR ELECTRONIC TIMEPIECE

[75] Inventors: Toshiyuki Masuda, Nara; Takehiko Sasaki, Yamatokoriyama, both of Japan

[73] Assignee: Sharp Kabushiki Kaisha, Osaka, Japan

[21] Appl. No.: 740,224

[22] Filed: Nov. 9, 1976

[30] Foreign Application Priority Data

Nov. 10, 1975 [JP] Japan ..... 50-135336

[51] Int. Cl.[3] ..... G04B 19/24

[52] U.S. Cl. ..... 368/29; 368/82; 368/239

[58] Field of Search ..... 58/4 A, 58, 23 R, 50 R, 58/38 R, 39.5; 368/69, 70, 82, 239, 29

[56] References Cited

U.S. PATENT DOCUMENTS 3,772,874 11/1973 Lefkowitz ..... 58/4 A X 3,889,458 6/1975 Kashio ..... 58/4 A

*Primary Examiner*—Ulysses Weldon

*Attorney, Agent, or Firm*—Birch, Stewart, Kolasch & Birch

[57] ABSTRACT

Seven symbol lamps are aligned, in addition to a six-digit numeral display for displaying time information, in order to indicate any one of the days of the week printed on a calendar panel. A mode panel is disposed, parallel to the calendar panel, on which labels representative of a month information correction mode, a date information correction mode, a day of the week information correction mode, an hour information correction mode, a minute information correction mode, and other operation modes such as a stop-watch mode are provided at positions corresponding to the seven symbol lamps. The symbol lamps are continuously enabled when they indicate the days of the week information printed on the calendar panel, and the symbol lamps are controlled to flicker when they indicate any one of the operation modes represented by the mode panel.

6 Claims, 7 Drawing Figures

$S_d$
WEEK COUNTER
18
s
PM
16
DECODER
19
$W_1$ $W_3$ $W_5$ $W_7$
$W_2$ $W_4$ $W_6$
20
20A-9
20C-9
20D-9
9
DRIVE
NORMAL MODE
$M_1$
STOP-WATCH MODE
$M_2$
20B-9
20A-10
20
20C-10
10
MONTH CORRECTION MODE
$M_3$
DRIVE
DAY OF THE WEEK CORRECTION MODE
$M_4$
20D-10
20B-10
20
11
DATE CORRECTION MODE
$M_5$
DRIVE
HOUR CORRECTION MODE
$M_6$
20
12
DRIVE
MINUTE CORRECTION MODE
$M_7$
20
13
DRIVE
17
20
14
DRIVE
20
15
DRIVE

DISPLAY PANEL FOR ELECTRONIC TIMEPIECE

BACKGROUND AND SUMMARY OF THE INVENTION

The present invention relates to an improvement for a display panel of an electronic timepiece.

Usually, in an electronic timepiece, time information as to hours, minutes, seconds, months, dates, days of the week, before noon or after midday, etc. is displayed through the use of numerals of four digits or six digits and characters or symbols other than numerals. When the time information as to hours, minutes and seconds is desired to be simultaneously displayed, a six-digit numeral display is required because the respective information sections require two-digit numerals.

When the information as to days of the week is desired to be displayed at the same time when the time information as to hours, minutes and seconds is displayed, characters or symbols are required in addition to the six-digit numeral display. One way to display such information is disclosed in U.S. Pat. No. 3,889,458 to Toshio Kashio, entitled "ELECTRONIC CLOCK DEVICES," wherein seven symbols are provided for indicating the information as to days of the week in addition to the four-digit numeral display for the hour and minute information.

In the case where a six-digit numeral display is employed, a stop-watch function can be easily achieved by an electronic timepiece, wherein the counted time information as to hours, minutes and seconds, or as to minutes, seconds and tenths of seconds is simultaneously displayed on the six-digit numeral display.

In an above-mentioned electronic timepiece which has a display panel including the six-digit numerals, the seven symbols for displaying the information as to days of the week, and one or more symbols provided between the numerals for displaying the hour information and the minute information in order to distinguish the hour information from the minute information, the information as to months, dates, days of the week, hours, minutes, seconds and before noon or after midday can be easily displayed and, moreover, the stop-watch function can be achieved. More particularly, the information as to hours, minutes, seconds and days of the week is simultaneously displayed, and the information as to months and dates is displayed through the use of any group of the numerals for displaying the hour information, minute information or second information by a suitable switch operation. And the stop-watch function is performed through a switch operation, thereby displaying the counted time information as to hours, minutes and seconds, or as to minutes, seconds and one tenth seconds.

In such an electronic timepiece, a time information correction operation is often erroneously conducted, because the six-digit numerals indicate different information depending on the operation modes of the electronic timepiece. And the operator can not recognize, at a glance, whether the timepiece is placed in the normal time information keeping mode, or the stop-watch function mode.

Accordingly, an object of the present invention is to improve a display panel of an electronic timepiece.

Another object of the present invention is to provide a display panel for an electronic timepiece which can identify operation modes of the electronic timepiece.

Still another object of the present invention is to indicate the identity of operation modes of the electronic timepiece through the use of seven symbols provided for indicating information as to days of the week.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a mode panel is disposed in with a calendar panel on which information as to days of the week is printed. On the mode panel, labels are fixed at the positions corresponding to the seven symbols for the days of the week information indication in order to indicate a month information correction mode, a date information correction mode, a day of the week information correction mode, an hour information correction mode, a minute information correction mode, and other operation modes such as a stopwatch operation mode.

The symbols are continuously enabled when they indicate the information as to days of the week printed on the calendar panel in the normal time information keeping operation mode, and the symbols are controlled to flicker when they indicate any one of the operation modes described on the mode panel.

The labels fixed to the mode panel can be represented in any language in dependence on the person who wears the electronic timepiece.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Referring now in detail to the drawings, and to facilitate a more complete understanding of the present invention, a display panel of an electronic timepiece of the prior art will be first described with reference to FIGS. 1 through 3.

Figure 1:
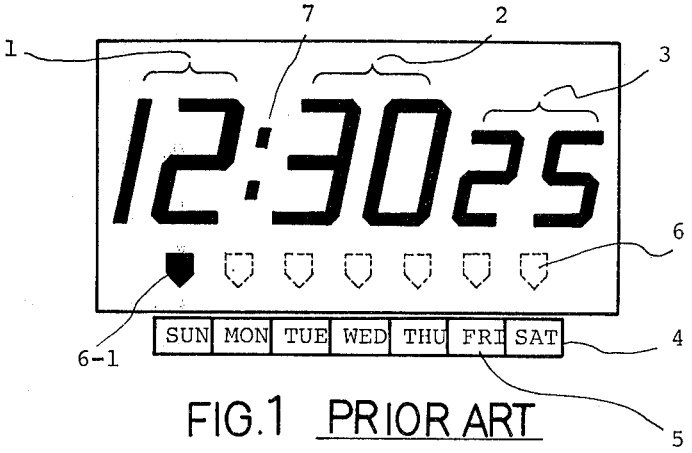
FIG. 1 PRIOR ART
FIG. 1 is a plan view of a display panel of an electronic timepiece of the prior art, which displays information as to hours, minutes, seconds and days of the week.

FIG. 1 shows a condition where information as to hours, minutes, seconds and days of the week is simultaneously displayed on a display panel of the prior art. A numeral group 1 represents the information as to hours, another numeral group 2 represents the time information as to minutes, and a numeral group 3 represents the time information as to seconds, respectively.

A character panel 4 includes a calendar panel 5 on which characters representative of the information as to days of the week are printed. Symbols 6 are provided at the positions corresponding to the respective characters printed on the calendar panel 5, whereby the operator recognizes that today is Sunday when a symbol 6-1 provided above a character "SUN" is enabled. Another symbol 7 is provided between the numeral groups 1 and 2, thereby distinguishing the hour information from the minute information.

Figure 2:
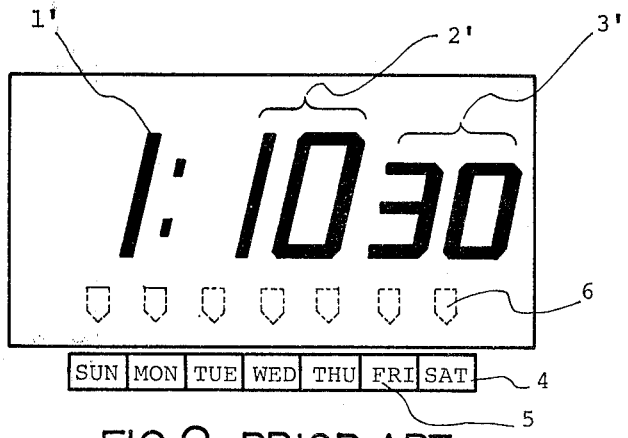
FIG. 2 PRIOR ART
FIG. 2 is a plan view of a display panel of an electronic timepiece of the prior art, which displays counted time information in a stop-watch mode.

FIG. 2 shows a condition where the electronic timepiece of FIG. 1 functions as a stop-watch by a suitable switch operation. A numeral group 1' represents the counted time information as to hours, a numeral group 2' represents the counted time information as to minutes, and a numeral group 3' represents the counted time information as to seconds, respectively. As compared with the display condition of FIG. 1, it is not clear whether the displayed information relates to the current time information in the normal mode or the counted time information in the stop-watch mode. The only difference is that none of the symbols 6 indicating the information as to days of the week are enabled in the stop-watch mode shown in FIG. 2.

Alternatively, the numeral groups 1', 2' and 3' can represent the counted time information as to minutes, seconds and tenths of seconds, respectively. Even in this case, it is difficult to determine whether the electronic timepiece is placed in the normal time keeping mode or in the stop-watch mode.

By a suitable switch operation, information as to months and dates is represented by the numeral groups 2 and 3, respectively. When the month information is desired to be corrected, only the numeral group 2" is enabled to indicate the month information as shown in FIG. 3. Also, when the minute information is desired to be corrected, only the numeral group 2 of FIG. 1 is enabled to indicate the minute information. Therefore, there is a possibility that the minute information is erroneously corrected even though the month information is desired to be corrected, since the operator is not instructed as to whether the information displayed by the numeral group 2" is the minute information or the month information.

As discussed above, in the case where more than two kinds of information are displayed on the same numeral group, it is difficult to distinguish or recognize which kind of information is displayed. The confusion is a matter of importance especially when the electronic timepiece is placed in the stop-watch mode, and the time information correction modes about the hour information, the minute information, the month information and the date information.

One such time information correction system which may be used with this invention is that shown and described in U.S. Pat. application Ser. No. 720,205 filed Sept. 3, 1976, "TIME INFORMATION CORRECTION IN COMBINATION TIMEPIECE AND CALCULATOR," assigned to the same assignee as the present invention, which is incorporated by reference herein. Another form of the time information correction is described in U.S. Pat. No. 3,810,356 to Kinji Fujita, "TIME CORRECTING APPARATUS FOR AN ELECTRONIC TIMEPIECE."

Figure 4:
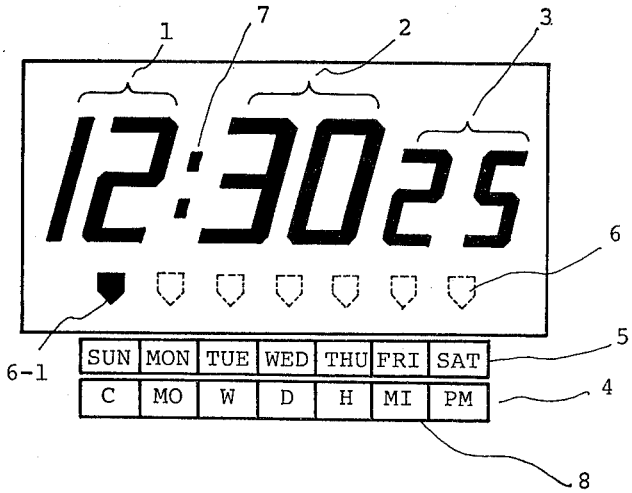
FIG. 4 is a plan view of an embodiment of a display panel of the present invention, which displays information as to hours, minutes, seconds and days of the week.
Figure 5:
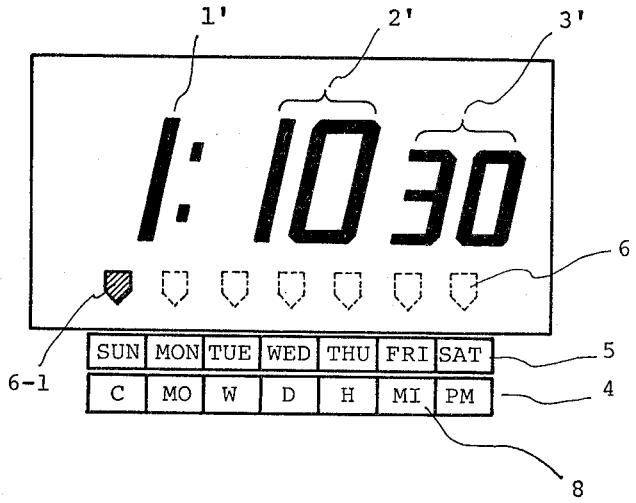
FIG. 5 is a plan view of the display panel of FIG. 4, which displays counted time information in a stop-watch mode.
Figure 6:
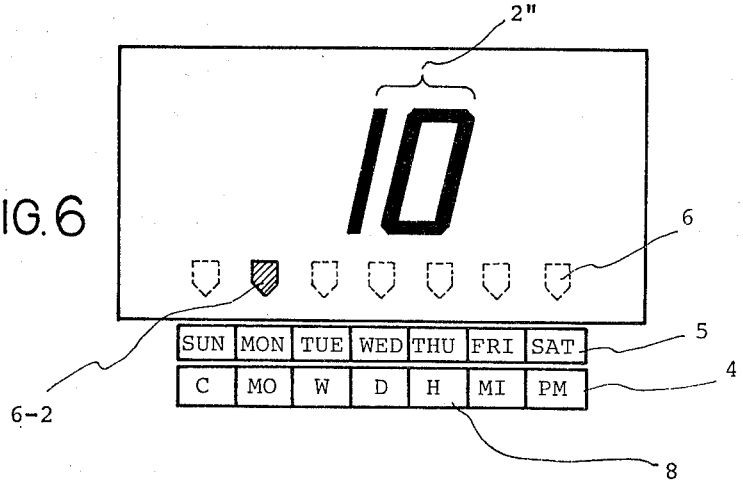
FIG. 6 is a plan view of the display panel of FIG. 4, which displays information as to months in a month information correction mode.

FIGS. 4 through 6 show examples of the display condition indicated by a display panel of the present invention. In this embodiment, a mode panel 8 is provided in the character panel 4 in addition to the calendar panel 5. The mode panel 8 includes characters printed thereon, which are representative of a stop-watch mode C, a month information correction mode MO, a days of the week information correction mode W, a date information correction mode D, an hour information correction mode H, a minute information correction mode MI, and the after midday PM mode.

FIG. 4 shows a condition where the display panel shows the time information of thirty minutes twenty-five seconds past twelve on Sunday, as in the case of FIG. 1. The symbol 6-1 is continuously enabled without flickering, thereby indicating the character SUN printed on the calendar panel 5.

FIG. 5 shows a condition where the electronic timepiece functions as a stop-watch. The symbol 6-1 is controlled to flicker at a frequency of a fraction of a hertz to several hertz, thereby indicating the character C printed on the mode panel 8. In this way, the operator easily recognizes that the electronic timepiece is placed in the operation mode shown by the mode panel 8 when the symbols 6 are controlled to flicker.

FIG. 6 shows a condition where the electronic timepiece is placed in the month information correction mode, which is indicated by the symbol 6-2. The symbol 6-2 is controlled to flicker as in the case of FIG. 5, thereby indicating the month information correction mode MO printed on the mode panel 8 which is positioned at the place corresponding to the symbol 6-2.

Figure 3:
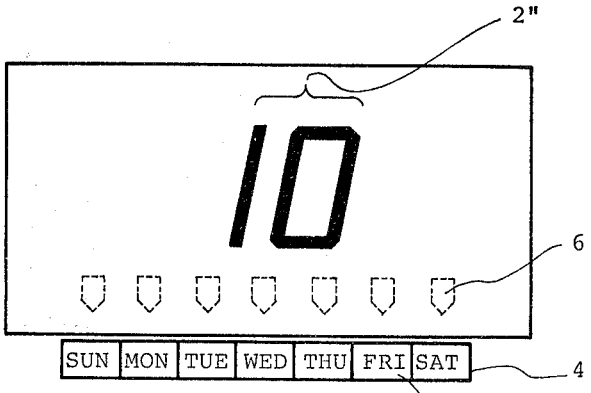
FIG. 3 PRIOR ART
FIG. 3 is a plan view of a display panel of an electronic timepiece of the prior art, which displays information as to months in a month information correction mode.

As discussed above, when the operation mode is indicated by flickering or variations of the brightness of a symbol 6, the display panel per se is not substantially changed or modified as compared with that of the prior art shown in FIGS. 1 through 3. When the symbol for indicating the information as to days of the week and the symbol for indicating the correction mode of the information as to days of week coincide with each other, for example, Tuesday in the days of the week information correction mode in the embodiment shown in FIGS. 4 through 6, the symbol 6 can be continuously enabled without flickering. In the hour information correction mode, the symbol 6 provided at the position corresponding to the PM mark printed on the mode panel 8 is controlled to flicker when the displayed hour information is ranged in the after midday. Needless to say, an AM mark can alternatively be provided on the mode panel 8 to indicate a time before noon.

Figure 7:
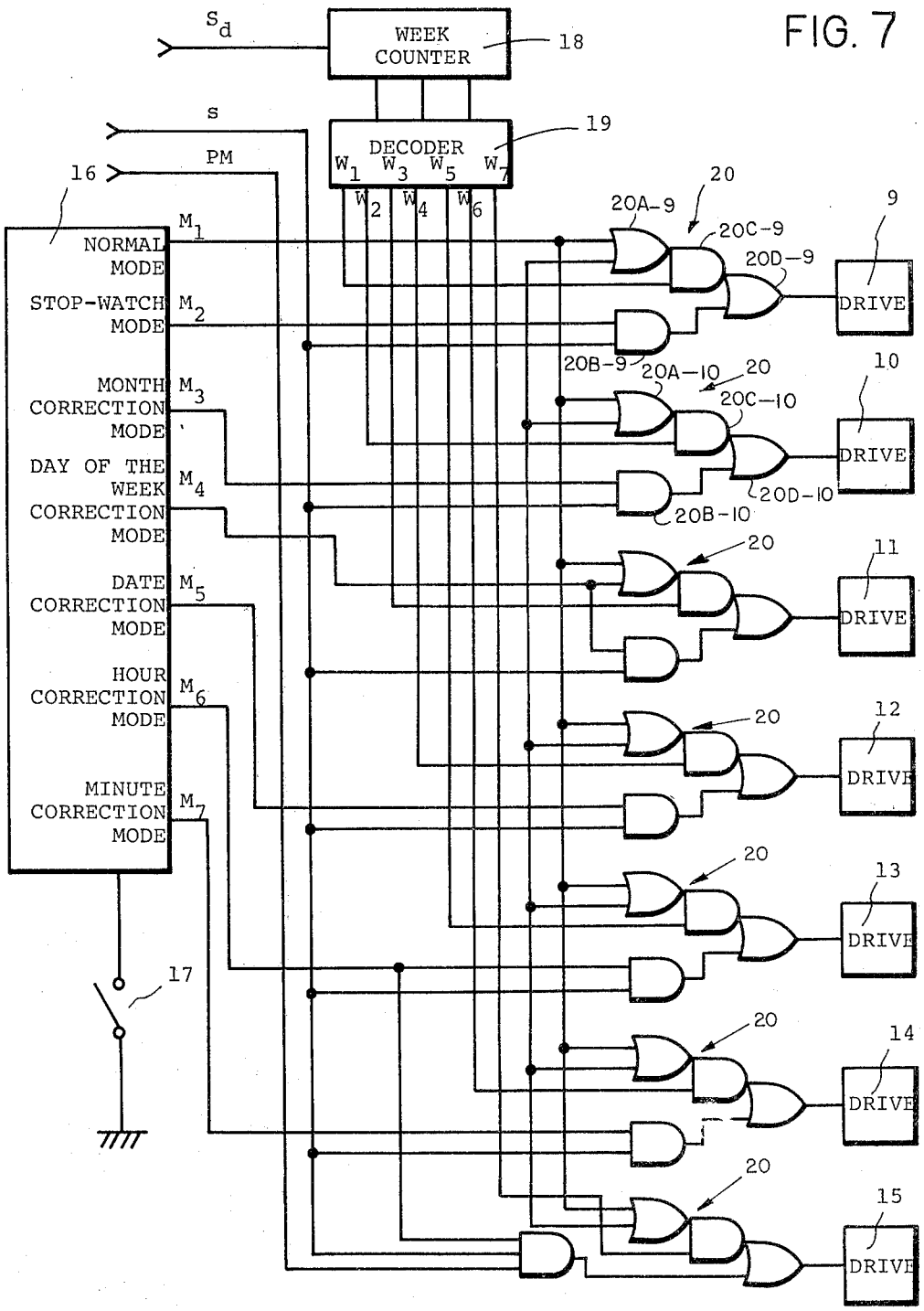
FIG. 7 is a block diagram of an embodiment of a control circuit for the display panel of the present invention.

FIG. 7 shows a control circuit of the display panel of the present invention. Drivers 9 through 15 are associated with the respective seven symbols 6. That is, the driver 9 is associated with the symbol 6-1 for indicating Sunday or the stop-watch mode. The driver 10 is associated with the symbol 6-2 for indicating Monday or the month information correction mode. The drivers 11 through 15 are associated with the symbols 6 for indicating Tuesday or the days of the week information correction mode, Wednesday or the date information correction mode, Thursday or the hour information correction mode, Friday or the minute information correction mode, and Saturday or the after midday, respectively.

A mode selection signal generator 16 is so constructed as to sequentially change the operation modes in the order of the normal mode, the stop-watch mode, the month information correction mode, the day of the week information correction mode, the date information correction mode, the hour information correction mode, the minute information correction mode, and again the normal mode upon every closing of a manual switch 17, and to develop mode signals $M_1$, $M_2$, $M_3$, $M_4$, $M_5$, $M_6$ and $M_7$ of a high level in response to the respective operation modes. A day of the week information counter 18 is connected to receive a date signal Sd, and develops signals $W_1$, $W_2$, $W_3$, $W_4$, $W_5$, $W_6$ and $W_7$ of a high level corresponding to Sunday, Monday, Tuesday, Wednesday, Thursday, Friday and Saturday, respectively, through a decoder 19. The "normal mode" represents the operation mode of the timepiece where the display panel simultaneously indicates a set of information consisting of the information as to hours, minutes, seconds and days of the week; as to hours, minutes, dates and days of the week; or as to months, dates and days of the week. The respective signals bear low levels when they are not at the high levels.

A one hertz signal s is required when it is desired to flicker the symbols 6, for example, when it is desired to flicker the symbol 6-1 in FIG. 5 or the symbol 6-2 in FIG. 6, at one hertz to indicate the characters printed on the mode panel 8 should be observed. An after midday signal PM is required, which bears the high level after midday, when the right end symbol is desired to flicker at one hertz after midday in the hour information correction mode.

The above-mentioned signals are introduced into gate circuits generally indicated 20. When the electronic timepiece is placed in the normal mode on Sunday, the driver 9 is energized via OR gate 20 A-9, AND gate 20C-9, and OR gate 20D-9; to enable the symbol 6-1 aligned with Sunday and the stop-watch mode as shown in FIG. 4. This occurs since AND gate 20C-9 receives high level signal $M_1$ at one terminal and high level signal $W_1$ via OR gate 20A-9 at the other terminal. In this case the symbol 6-1 is not controlled to flicker the flicker signal s being blocked by the absence of a signal at the upper terminal of AND gate 20B-9. Therefore, the operator can recognize that the symbol 6-1 indicates Sunday SUN printed on the calendar panel 5.

When the electronic timepiece is placed in the stop-watch mode through the next actuatron of manual switch 17, AND gate 20B-9 receives the mode signal $M_2$ and the one hertz signal s at its two terminals and, therefore, the symbol 6-1 flickers at one hertz since signal s passes through OR gate 20D-9 to driver 9; thereby indicating the stop-watch mode C printed on the mode panel 8 as shown in FIG. 5 should be observed.

When the electronic timepiece is placed in the month information correction mode through the manual switch 17, AND gate 20B-10 receives the mode signal $M_3$ at its upper terminal and the one hertz signal s at its lower terminal and, therefore, the symbol 6-2 flickers at one hertz since signal s passes through OR gate 20D-10 to driver 10, thereby indicating the month information correction mode MO printed on the mode panel 8 as shown in FIG. 6.

The remaining combinations of AND and OR gates 20 associated with drivers 11 to 15 function in an identical manner as signals $M_4$ to $M_7$, respectively, are received at the respective inputs of the AND gates simultaneously with flicker signal S upon each successive closing of switch 17.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A display panel for an electronic timepiece comprising:
   - a multi-digit numeral display for displaying time information in a digital fashion;
   - a plurality of aligned symbol designators;
   - a calendar panel including information as to days of the week provided at positions corresponding to the respective symbol designators;
   - a mode panel including information as to operation modes of the electronic timepiece other than a normal time of day keeping mode provided at positions corresponding to the respective symbol designators; and
   - a control circuit for enabling the respective symbol designators in such a manner that the respective symbol designators are continuously enabled when they designate the information provided by the calendar panel, and that the respective symbol designators are controlled to flicker at a given frequency when they designate the information provided by the mode panel.

2. The display panel of claim 1, wherein the respective symbol designators are controlled to flicker at one hertz when they designate the information provided by the mode panel.

3. The display panel of claim 1, wherein the multi-digit numeral display is a six-digit numeral display and the symbol designators are seven symbols aligned in a line.

4. The display panel of claim 3, wherein the calendar panel includes seven kinds of information representative of Sunday, Monday, Tuesday, Wednesday, Thursday, Friday and Saturday, and the mode panel includes seven kinds of information representative of a stop-watch mode, a month information correction mode, a day of the week information correction mode, a date information correction mode, an hour information correction mode, a minute information correction mode and a time of day after midday.

5. In a display panel for an electronic timepiece which is capable of displaying time information in a digital fashion through the use of a multi-digit numeral display and information as to days of the week through the use of selectively activated designator symbols which selectively designate the proper day of the week as determined by the timepiece, the improvement comprising:
   - a calendar panel on which information as to days of the week is provided at positions corresponding to positions of said symbol designators;
   - a mode panel on which information for indicating operation modes other than a normal time of day keeping mode of the electronic timepiece, said information being provided at positions corresponding to said days of the week information and said symbol designators; and control means for instructing an observer reading said timepiece as to whether said designator symbols are selectively designating information on said calendar panel or on said mode panel, said control means including circuit means for selectively enabling said symbol designators so that the symbol designators show different activated conditions when instructing an observer to read designated information on said mode panel, as compared to when said symbol designator is instructing said observer to read designated information from said calendar panel.

6. The display of claim 5 wherein said symbol designators comprise seven designators aligned with seven day characters representing the seven days of a week and said mode panel includes seven mode characters aligned with each of said seven day characters.

* * * * *